US006168363B1

(12) United States Patent
Nehring

(10) Patent No.: US 6,168,363 B1
(45) Date of Patent: Jan. 2, 2001

(54) DEVICE FOR ROUNDING AND BACKING BOOK BLOCKS

(75) Inventor: Dieter Nehring, Bad Oeynhausen (DE)

(73) Assignee: Kolbus GmbH & Co. KG, Rahden (DE)

( * ) Notice: Under 35 U.S.C. 154(b), the term of this patent shall be extended for 0 days.

(21) Appl. No.: 09/470,484

(22) Filed: Dec. 22, 1999

(30) Foreign Application Priority Data

Dec. 22, 1998 (DE) ..... 198 59 332

(51) Int. Cl.[7] ..... B42C 5/02

(52) U.S. Cl. ..... 412/30; 412/9; 412/22; 412/25

(58) Field of Search ..... 412/9, 25, 22, 412/30

(56) References Cited

U.S. PATENT DOCUMENTS 5,114,293 * 5/1992 Rathert ..... 412/30

FOREIGN PATENT DOCUMENTS

OS 15 36 507 1/1970 (DE) .
36 13 120 C2 10/1987 (DE) .
40 05 948 A1 8/1991 (DE) .

* cited by examiner

*Primary Examiner*—A. L. Wellington
*Assistant Examiner*—Mark T. Henderson
(74) *Attorney, Agent, or Firm*—Alix, Yale & Ristas, LLP

(57) ABSTRACT

A device for rounding and pressing book blocks with a conveying device for the book blocks. The device includes rounding rollers, pressing jaws or similar clamping elements, which are displaceable relative to one another, which act to receive the book block and act with a predefined force upon the book block. The device automatically adjusts the clamping elements to different formats of the book block and, in the event of deviations in the book block thickness, the clamping elements are displaceable relative to one another via articulately connected levers. The levers function to clamp the book block via an operating cylinder acting upon the free ends of the levers and automatically aligning the book block. The point of rotation of the levers being displaceably mounted in a guide aligned with the center of the conveying device of the book block.

9 Claims, 1 Drawing Sheet

DEVICE FOR ROUNDING AND BACKING BOOK BLOCKS

BACKGROUND OF THE INVENTION

1. Field of the Invention

The invention relates to a device for rounding and pressing book blocks and, more particularly, to a device for rounding and pressing book blocks having rounding rollers, pressing jaws or similar clamping elements, which are displaceable relative to one another, receive the book block and act with a defined force upon the book block.

2. Description of Related Art

In industrial book production, the book block with a rounded back receives the desired back shape corresponding to the cover type in the pressing processing section, said back shape being determined by a fold provided in the region of the back of the book block, which fold can be constructed either as a deep or flat fold. The pressing is effected by a molding tool, which is reciprocated over the width of the back of the book block and comprises a concave active surface, so that by applying pressure and friction, the folded printed sheets are bent over on both sides from the center of the book block back, namely at an angle increasing towards the outside. In this manner, the book block receives its mushroom-like back shape and at the same time a back stabilization. In order to effect the pressing procedure, the book block is clamped between pressing strips in such a manner that the rounded end is exposed and over hangs the pressing strips.

A pressing machine with a molding tool acting upon the book block back and with clamping jaws holding the book block is known, for example, from DE-OS 15 36 507. Proceeding from a cam disk with a cam roller supported by a toggle lever and running in a cam track, with articulated levers and further members, the two clamping jaws are displaced towards one another and hold the book block with a predetermined constant clamping force in order to effect the pressing procedure. Since the book blocks can vary in their thickness, the holding force cannot be optimally adjusted, with the result that, in the case of an excessive holding force, impressions are made on the book block or, in the case of a holding force which is too weak, a position displacement or slippage occurs in the clamping jaws. For different formats of the book blocks the clamping jaws can be mechanically adjusted relative to one another. This adjustment is time-consuming and therefore results in substantial production interruption.

In the Patent DE 36 13 120 assigned to the assignee hereof, a device on a book binding machine for adjusting clamping jaws via adjustment drives for providing different formats and different clamping forces for holding the book block is disclosed. To achieve this an external, electronic measuring device is used wherein a master block is clamped in place and the thickness of the master block is determined as a distance-dependent actual value which is evaluated in a computer and stored as a nominal value. The nominal value is transmitted via a control device to the adjustment drive as an adjustment value.

SUMMARY OF THE INVENTION

It is an object of the invention to provide a device for rounding and pressing book blocks in which the clamping elements automatically adjust to different formats of the book block.

It is another object of the invention to provide a device in which the clamping elements automatically adjust to deviations in book block thickness.

It is a further object of the invention to allow for a simple product-dependent adjustment of the holding force in the clamping elements.

The above objects and other objects are achieved in accordance with an embodiment of the invention wherein the clamping jaws are displaceable relative to one another by levers which are articulated for providing automatic alignment of the book block. The clamping jaws clamp the book block via an operating cylinder that acts upon the free ends of the levers. The point of rotation of the levers is displaceably mounted in a guide aligned with the center of the conveying device of the book block. According to a further feature of the invention, the clamping elements are arranged in the form of pressing jaws on levers of a scissor system and clamp the book block by lever action via an operating cylinder acting upon the opposite ends of the levers, the axis of rotation of the scissor system being displaceably mounted in the guide.

Until now, the adjustment of the clamping elements to different book blocks has been effected mechanically or in connection with an external, electronic measuring device requiring the insertion of a master book block. In accordance with the present invention, a lever system is employed which is actuated by an operating cylinder and is centrally mounted in relation to the conveying device. The lever system comprises articulatedly connected levers which provide automatic alignment with the book block, symmetric closure of the clamping elements and automatic compensation for deviations in the book block thickness. As a result of the use of the lever system the adjustment of the clamping elements is effected, in a surprisingly simple and economic fashion. In order to carry out the pressing procedure, for example, the book block is held with the optimum holding force in the pressing jaws, which protects the product and contributes to the operational reliability of the device. Furthermore, the clamping force can be easily adjusted and limited, so that even delicate materials are always clamped with an optimal clamping force and are therefore held carefully in the pressing jaws.

BRIEF DESCRIPTION OF THE DRAWINGS

An embodiment of the invention is described in further detail in conjunction with the accompanying drawings, in which.

DETAILED DESCRIPTION OF THE PREFERRED EMBODIMENT

The following applications have been filed contemporaneously herewith and each of which are incorporated herein by reference. U.S. patent application entitled "A Device For Backing Book Blocks", U.S. App. No. 09/467,572 U.S. patent application entitled "Device For The Back Rounding Of Book Blocks", U.S. App. No. 09/468,149 U.S. patent application entitled "A Book Production Line", U.S. Pat. No. 09/470,617.

Figure 1:
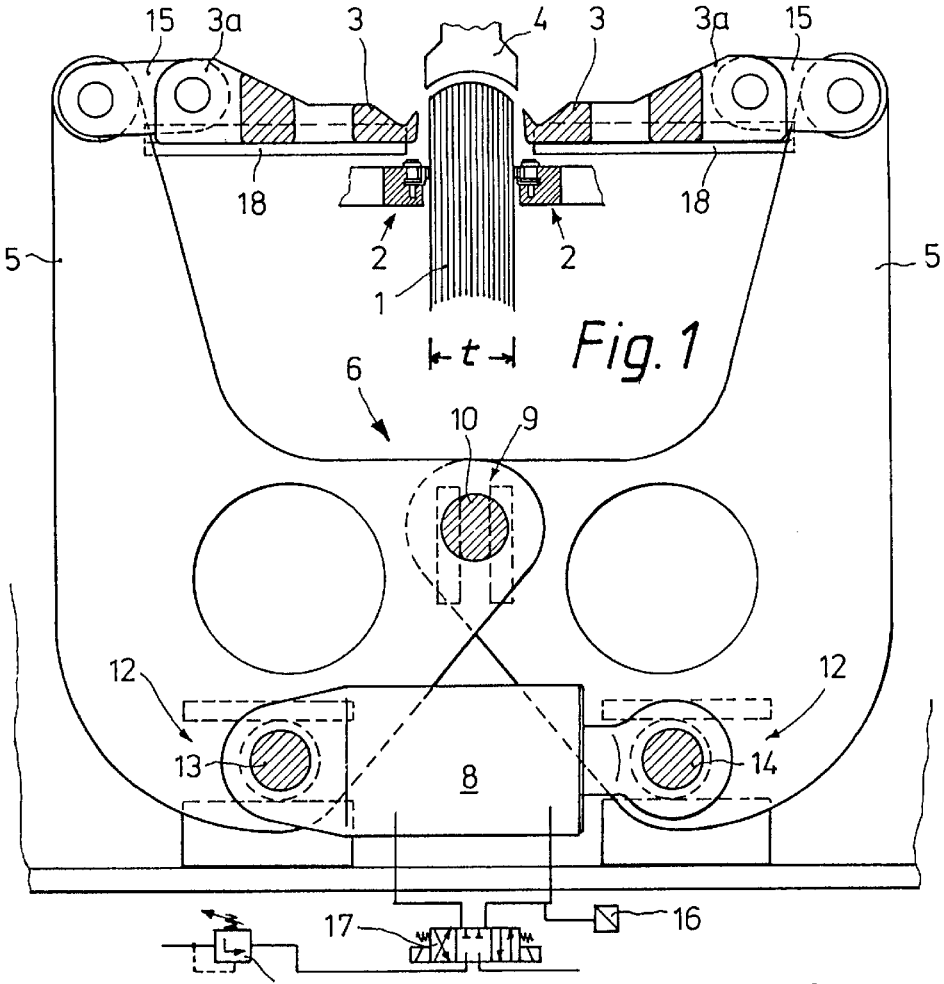
FIG. 1 is a sectional view taken along line A–B in FIG. 2 of a device for rounding and backing book blocks in accordance with an embodiment of the present invention.
Figure 2:
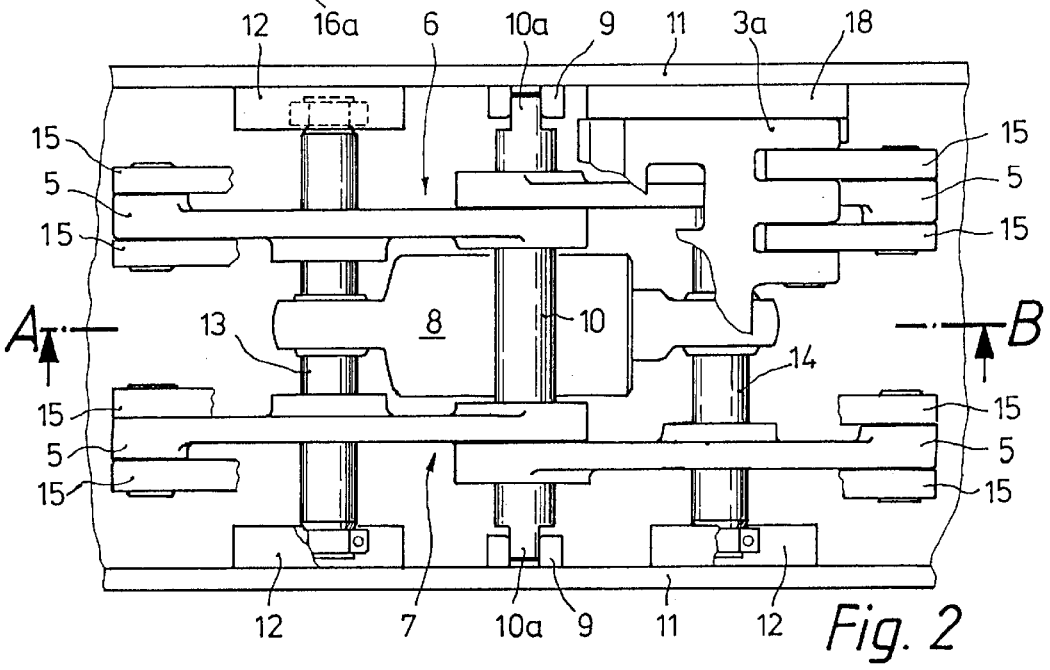
FIG. 2 is a plan view of the device, partially broken away.

Referring to FIGS. 1 and 2, a book block rounding and pressing machine is shown wherein book blocks 1 having a thickness, following a back rounding process, enter a pressing station, in which the book block with a rounded back receives the back shape which is determined by a fold provided in the region near the back of the book block. The book blocks 1 supplied by a support chain conveyor 2 are received by clamping elements, e.g., pressing jaws 3 extending over the height of the book block and during the pressing process in the region near the back are held in such a manner that a defined overhang is present as seen from the rounding end. The pressing is effected in known manner by a molding tool 4 reciprocating over the width of the back of the book block 1.

In accordance with an embodiment of the present invention, the pressing jaws 3 are arranged via coupling elements 15 on levers 5 of two scissor systems 6 and 7 lying at a defined distance parallel to one another and actuated by a hydraulic cylinder 8. The axis of rotation of the scissor systems 6 and 7 is aligned with the center of the support chain conveyor 2 and rotates in a vertical plane in order to open and close the scissor systems 6 and 7. The levers 5 are freely rotatably arranged on a common shaft 10 that is displaceably guided with peripheral guide surfaces 10*a* in linear guides 9 of lateral frames 11. In order to allow for a correction of the center alignment in relation to the molding tool 4, the linear guides 9 can be adjusted via means, not shown.

For the closing movement of the scissor systems 6 and 7 in order to apply the holding force to the book block 1 between the pressing jaws 3, the levers 5 of the scissor systems are freely rotatably mounted at their ends on shafts 13 and 14 and are displaceable via the hydraulic cylinder 8 in guides 12 of the lateral frames 11 and are thereby guided with precision. The book blocks 1 are always held with the optimal holding force between the pressing jaws 3. The holding force can also be adjusted and limited via a control valve 17 with a pressure regulator 16 and sensor 16*a,* so that even delicate materials can be clamped carefully with the optimum retaining force. The hydraulic cylinder 8 is actuated in such a manner that the pressing jaws 3 only open in timed fashion by a small distance, in order to ensure the uptake and release of the book block 1.

The pressing jaws 3 are displaceably supported on horizontal bearing surfaces 18 and are articulately connected with forked bearings 3*a* via coupling elements 15 to the levers 5 of the two scissor systems 6 and 7.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. A device for rounding and backing book blocks each having a thickness, the device receiving book blocks from a conveyor, the device for rounding and backing book blocks comprising:

a frame;

a plurality of spaced clamping elements displaceable relative to one another by articulatedly connected levers for receiving a book block from the conveyor and acting with a predefined force upon the book block;

said articulatedly connected levers having first ends being interconnected with the clamping elements, the levers being rotatably and displaceably supported by the frame; and an operating cylinder for acting upon second ends of the levers.

2. The backing and rounding device according to claim 1, wherein:

the clamping elements comprise pressing jaws connected to the levers.

3. The backing and rounding device according to claim 1, wherein the operating cylinder includes a hydraulic cylinder acting upon the second ends of the levers.

4. The backing and rounding device according to claim 1, further comprising a control device for adjusting the pressing force between the clamping elements.

5. The backing and rounding device according to claim 2, further comprising a control device for adjusting the pressing force between the clamping elements.

6. A device according to claim 1 wherein:

each of the levers has an axis of rotation;

each of the levers is displaceably mounted in a first guide for guiding displacement of the levers and the first guide being aligned with a center of the conveyor of the book block; and each of the levers is displaceably mounted in a second guide such that the clamping elements symmetrically clamp the book block and align the book block with the center of the conveyor.

7. The backing and rounding device according to claim 6, further comprising a scissor system including the levers for clamping the book block by action of the levers and wherein an axis of rotation of the scissor system is displaceably mounted in the guide.

8. A device according to claim 6, wherein the second guide is adjustable to effect a correction of the alignment of the clamping elements.

9. The backing and rounding device according to claim 7, further comprising a control device for adjusting the pressing force between the clamping elements.

* * * * *